US008814429B2

(12) United States Patent
Roether et al.

(10) Patent No.: US 8,814,429 B2
(45) Date of Patent: Aug. 26, 2014

(54) WOVEN TEXTILE ACCESSORIES

(75) Inventors: Julia Roether, Portland, OR (US); Thomas G. Bell, Portland, OR (US); Tory M. Cross, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/599,544

(22) Filed: Aug. 30, 2012

(65) Prior Publication Data

US 2013/0051709 A1 Feb. 28, 2013

Related U.S. Application Data

(60) Provisional application No. 61/529,049, filed on Aug. 30, 2011.

(51) Int. Cl.
*B65D 33/28* (2006.01)
*B65D 30/04* (2006.01)

(52) U.S. Cl.
USPC ..... 383/75; 383/117

(58) Field of Classification Search
USPC ..... 383/35, 117, 75; 139/389
See application file for complete search history.

(56) References Cited

U.S. PATENT DOCUMENTS

| | | | | |
|---|---|---|---|---|
| 264,526 | A * | 9/1882 | Grauwiler | 139/389 |
| 735,560 | A * | 8/1903 | Muller | 383/76 |
| 768,378 | A * | 8/1904 | Knibbs et al. | 139/389 |
| 2,425,683 | A * | 8/1947 | Martin | 383/6 |
| 3,807,200 | A * | 4/1974 | Liwski | 66/170 |
| 4,674,664 | A * | 6/1987 | Simon | 224/604 |
| 4,807,299 | A | 2/1989 | Nattrass et al. | |
| 5,052,555 | A | 10/1991 | Harmon | |
| 5,100,005 | A | 3/1992 | Noble et al. | |
| 5,222,812 | A | 6/1993 | Cuddy et al. | |
| 5,456,062 | A | 10/1995 | Wechsler | |
| 5,692,660 | A | 12/1997 | Stewart | |
| 5,813,445 | A | 9/1998 | Christman | |
| 5,881,850 | A | 3/1999 | Murdoch | |
| 5,980,108 | A | 11/1999 | Pasbrig | |
| 5,989,660 | A | 11/1999 | Moriwaki et al. | |
| 6,056,438 | A | 5/2000 | Bradley | |
| 6,126,003 | A | 10/2000 | Brouard | |
| 6,129,254 | A | 10/2000 | Yu | |

(Continued)

FOREIGN PATENT DOCUMENTS

WO 2008063385 5/2008

OTHER PUBLICATIONS

Notification of Transmittal of the International Search Report and the Written Opinion of the International Searching Authority, or the Declaration in PCT/US2012/53190 mailed Nov. 13, 2012, 10 pages.

(Continued)

*Primary Examiner* — Jes F Pascua
(74) *Attorney, Agent, or Firm* — Shook, Hardy & Bacon L.L.P.

(57) ABSTRACT

Woven textile structures constructed using dual-loom technology are provided. Filaments are woven in such a way as to create a first set of different discrete layers of the same fabric in some regions of the textile and a second set of discrete layers of the same fabric at other regions of the same textile. The different layers are used to construct various textile structures such as a woven bag with woven channels containing at least one drawstring.

15 Claims, 2 Drawing Sheets

(56) References Cited

U.S. PATENT DOCUMENTS

| | | | | |
|---|---|---|---|---|
| 6,186,662 | B1 | 2/2001 | Jackson | |
| 6,349,750 | B1 | 2/2002 | Fujiwara | |
| 7,069,961 | B2 | 7/2006 | Sollars, Jr. | |
| 7,836,917 | B1 | 11/2010 | Osborne | |
| 7,836,918 | B1 | 11/2010 | Osborne | |
| 7,841,369 | B1 | 11/2010 | Osborne | |
| 2004/0139629 | A1 | 7/2004 | Wiener | |
| 2006/0283680 | A1 | 12/2006 | Hollin et al. | |
| 2007/0019891 | A1* | 1/2007 | Daniel | 383/105 |
| 2007/0084866 | A1 | 4/2007 | Saeugling | |
| 2007/0137959 | A1 | 6/2007 | Zauderer | |
| 2008/0035694 | A1 | 2/2008 | Sisk et al. | |
| 2008/0237068 | A1 | 10/2008 | Melamed | |
| 2009/0129866 | A1 | 5/2009 | Smallwood et al. | |
| 2009/0194541 | A1 | 8/2009 | Mayo | |
| 2010/0172603 | A1 | 7/2010 | Lin | |
| 2011/0088285 | A1 | 4/2011 | Dorjan et al. | |
| 2011/0113650 | A1 | 5/2011 | Hurd et al. | |
| 2011/0302804 | A1 | 12/2011 | Hooper | |

OTHER PUBLICATIONS

Notification of Transmittal of the International Search Report and the Written Opinion of the International Searching Authority, or the Declaration in PCT/US2012/53193 mailed Nov. 23, 2012, 27 pages.

Notification of Transmittal of the International Search Report and the Written Opinion of the International Searching Authority, or the Declaration in PCT/US2012/53194 dated Nov. 30, 2012, 15 pages.

Notification of Transmittal of the International Search Report and the Written Opinion of the International Searching Authority, or the Declaration in PCT/US2012/053160 mailed Dec. 7, 2012, 55 pages.

Non-Final Office Action in U.S. Appl. No. 13/599,531 mailed Jan. 15, 2014, 26 pages.

Non-Final Office Action in U.S. Appl. No. 13/599,476 mailed Feb. 11, 2014, 20 pages.

* cited by examiner

WOVEN TEXTILE ACCESSORIES

CROSS-REFERENCE TO RELATED APPLICATIONS

This application, claims the benefit of U.S. Provisional Application No. 61/529,049, filed Aug. 30, 2011, entitled "Woven Textile Apparel and Accessories;" and is related by subject matter to the following concurrently filed U.S. patent applications: U.S. patent application Ser. No. 13/599,531, entitled "Woven Textile Bag;" U.S. patent application Ser. No. 13/599,512entitled "Woven Textile Shoes" and U.S. patent application Ser. No. 13/599,476, entitled "Woven Textile Organizer for bag". The entirety of the aforementioned applications are incorporated by reference herein.

STATEMENT REGARDING FEDERALLY SPONSORED RESEARCH OR DEVELOPMENT

Not applicable.

TECHNICAL FIELDS

The present invention relates to woven textile accessories. More specifically, the present invention relates to a woven bag with one or more woven channels containing a drawstring.

BACKGROUND

Traditionally, apparel and accessories such as bags, shoes, and jackets have been constructed by stitching or affixing together different panels of textile materials. With heavy or repetitive use, the textile panels can rip or separate along the affixed seams which limit the lifespan of these structures. As well, this mode of construction is typically labor-intensive because the different panels of textile materials need to be cut and sewn together.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, the present invention is directed toward constructing a variety of textile structures from a multi-layer woven fabric using dual-loom technology. The dual-loom technology is used to weave filaments in such a way as to create a first set of different discrete layers of the same fabric in some regions of a textile and a second set of different discrete layers of the same fabric at other regions of the same textile. The different layers may be used to construct various textile structures, such as a woven bag with woven channels containing one or more drawstrings, and an opening. Because the layers that define the different textile structures are continuously woven from the same filaments, there is minimal need to sew different pieces of material together to create the structure. The result is a durable woven textile structure that resists heavy, repetitive use better than standard stitched structures. This mode of manufacturing can also significantly reduce manufacturing costs because it is less labor intensive.

BRIEF DESCRIPTION OF THE DRAWINGS

Examples are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed toward constructing a variety of textile accessories from a multi-layer woven fabric using dual-loom technology. The dual-loom technology is used to weave filaments in such a way as to create a first set of different discrete layers of the same fabric in some regions of a textile and a second set of different discrete layers of the same fabric at other regions of the same textile. The different layers may be used to construct various textile structures, such as a woven bag with woven channels containing one or more drawstrings, and an opening. Because the layers that define the different textile structures are continuously woven from the same filaments, there is minimal need to sew different pieces of material together to create the structure. The result is a durable woven textile structure that resists heavy, repetitive use better than standard stitched structures. This mode of manufacturing can also significantly reduce manufacturing costs because it is less labor intensive. Air-jet looms and/or water-jet looms may be used to construct bags or other types of apparel and/or accessories in accordance with the present invention, some examples of which are described herein. One example of suitable air-jet looms for use in practicing methods in accordance with the present invention and in constructing woven textile items in accordance with the present invention are air-jet looms available from Dornier Machinery Corporation of Charlotte, N.C.

More specifically, the present invention is directed toward a bag constructed from a multi-layer woven fabric using dual-loom technology. The dual-loom technology is used to weave filaments in such a way as to create different layers of the same fabric; the different layers define a cavity, channels containing one or more drawstrings, and an opening. Because the layers that define the channels are continuously woven from the same filaments as the remainder of the bag, there is no need to sew different pieces of material together to create the channel.

Figure 1:
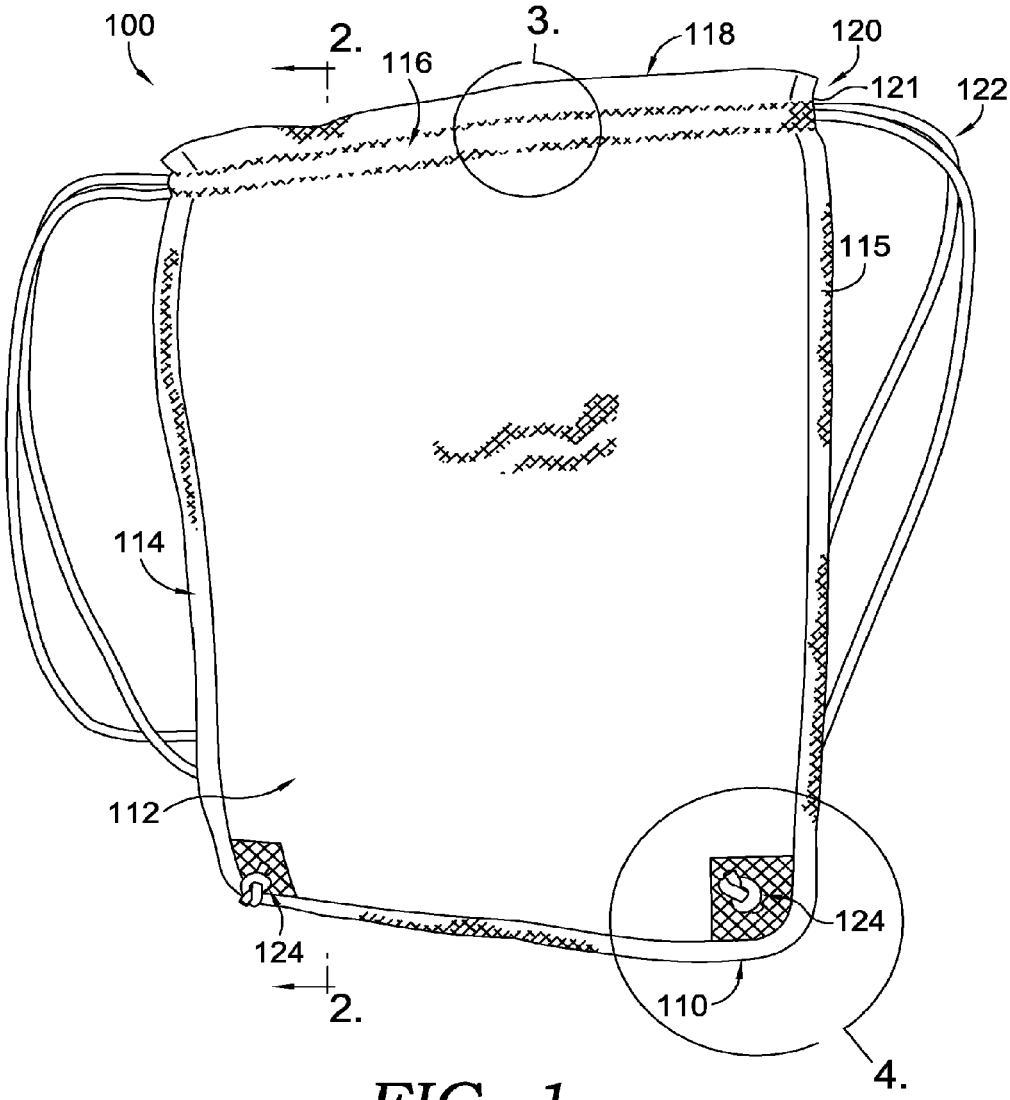
FIG. 1 depicts a woven bag in a flattened position in an embodiment of the present invention.

FIG. 1 illustrates a woven bag 100 as seen in a flattened position. The woven bag 100 may be constructed from a multi-layered woven textile fabric, such as those formed on Jacquard machines or Dobby looms. The woven bag 100 may be woven of nylon or polyester filamentary materials, but other filamentary materials may also be used. The filaments are interwoven in a locking pattern that provides substantial stability to the woven bag 100. The woven bag 100 may also be woven so that a graphic design is incorporated into the weave. The graphic design may be of the same color as the rest of the woven bag 100, or, alternatively, the graphic design may be woven using one or more different filament colors. In one aspect, the graphic design may comprise a logo.

The woven bag 100 may have a terminal end portion 110. The terminal end portion 110 may be formed as a single fabric of up to eight layers of thickness. Two side panels 112 (only one of which is shown) contiguously extend from the terminal end portion 110. The two side panels 112 partially define a cavity (i.e., the interior of the woven bag 100) and are woven from the same filaments that make up the terminal end portion 110. In other words, they are continuously woven from the terminal end portion 110. In one aspect, the two side panels 112 each comprise a single fabric of up to four layers of thickness.

The two side panels 112 are woven together at a first side portion 114 and a second side portion 115 to further define the cavity. In one aspect, the first side portion 114 and the second side portion 115 are continuous extensions of the terminal end portion 110. Thus, the first side portion 114 and the second side portion 115 comprise a single fabric of up to eight layers of thickness.

Near to the terminal end portion 110, and, for example, the first side portion 114, is an area 124 useable for affixing an end of a drawstring 122 to the woven bag 100. As shown in the illustrated embodiment, the area 124 may be present on both the first side portion 114 and the second side portion 115 of the woven bag 100 when in a flattened position. Or the area 124 may be present on just the first side portion 112 or the second side portion 115 of the woven bag 100 when in a flattened position. Further, the area 124 may be woven with reinforcing filaments.

Figure 4:
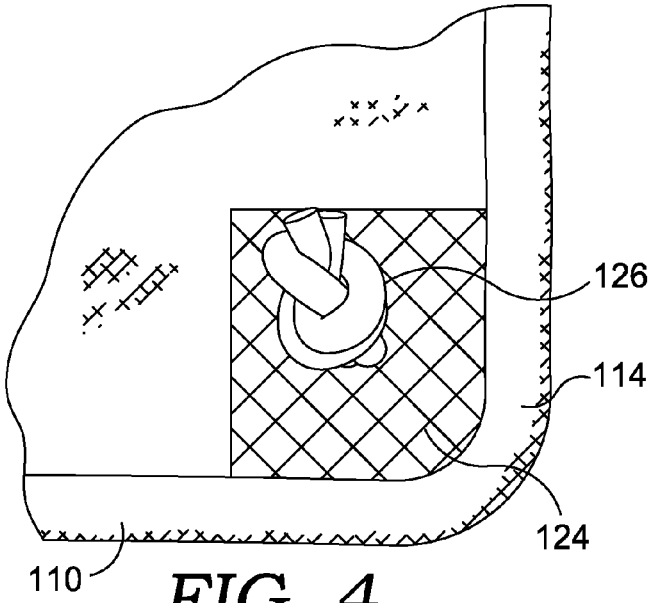
FIG. 4 depicts an exploded view of the bag depicted in FIG. 1 illustrating the drawstring attached to the woven bag at a terminal end of the bag in an embodiment of the present invention.

FIG. 4 is an exploded view of the area 124. FIG. 4 illustrates how, in one aspect, the area 124 comprises a single layer of fabric that is continuously woven from the terminal end portion 110 and at least one of the side portions (i.e., the first side portion 114 and/or the second side portion 115). Thus, in one aspect, the area 124 may comprise a single fabric of up to eight layers of thickness. In one aspect of the invention, a hole 126 in the area 124 may be created by altering the weaving pattern to create the hole 126. The end of the drawstring 122 may be threaded through the hole 126 in order to secure it to the woven bag 100. In another aspect of the invention, the hole 126 may be created using die cut technology. In one aspect, the weaving pattern of the area 124 acts to reinforce the hole 126. In another aspect, the hole 126 may be further reinforced by stitching.

Figure 3:
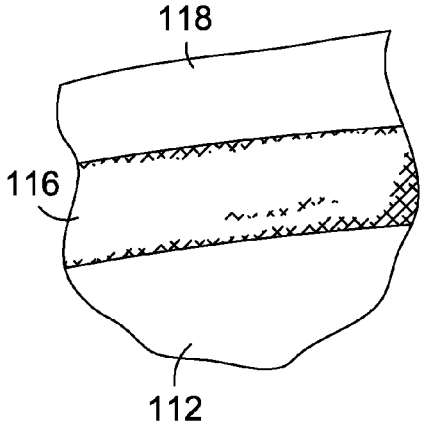
FIG. 3 depicts an exploded view of the bag depicted in FIG. 1 illustrating a channel used to contain a drawstring in an embodiment of the present invention.

Returning to FIG. 1, the woven bag 100 further comprises at least a first open-ended channel 116. The first channel 116 is created by panels that contiguously extend from one of the side panels 112. The panels that form the first channel 116 are woven from the same filaments as the side panel 112 and are woven continuously from the side panel 112. In one aspect, each panel that forms the first channel 116 comprises a single piece of fabric of up to two layers of thickness. FIG. 3 is an exploded view of the first channel 116. As can be seen from FIG. 3, the first channel 116 is formed without the use of stitching.

Likewise, a second channel (not shown in this figure) may be created by panels that contiguously extend from the other one of the side panels 112. This second channel is similar to the first channel 116 in that the second channel may be woven from the same filaments as the other side panel 112 and may be woven continuously from the other side panel 112. In one aspect, each panel that forms the second channel comprises a single piece of fabric of up to two layers of thickness. Like above, the second channel is formed without the use of stitching.

The first channel 116 may have an aperture 120 at least at one end. The aperture 120 may be created by altering the weaving pattern in such a way as to create the aperture, or the aperture 120 may be created by incising across the length of the channel. The aperture 120 may, in one aspect, be reinforced by stitching 121. The aperture 120 may also extend across both ends of the first channel 116 when the bag 100 is in a flattened position. The second channel may also have an aperture 120 across one or both ends of the channel.

The first channel 116 and the second channel provide a conduit for the drawstring 122; the drawstring 122 is used to close the woven bag 100. After leaving the first channel 116 and the second channel through one or both of the apertures 120, the drawstring 122 loops around and is further attached to the woven bag 100 at the area 124. The drawstring 122 may exit from one or both sides of the bag 100 when the bag 100 is in a flattened position. The drawstring 122 may be constructed from any textile material including cotton, nylon, polyester, and the like.

Continuing on, the woven bag 100 further comprises two end portions 118 of which only one is shown. The end portion 118 is created by weaving together the two panels that formed the first channel 116. The end portion 118 is woven from the same filaments as the panels that comprise the first channel 116 and are woven continuously from these panels. In one aspect, the end portion 118 comprises a single piece of fabric of up to four layers of thickness. The two end portions 118 define an opening into the bag 100.

Figure 2:
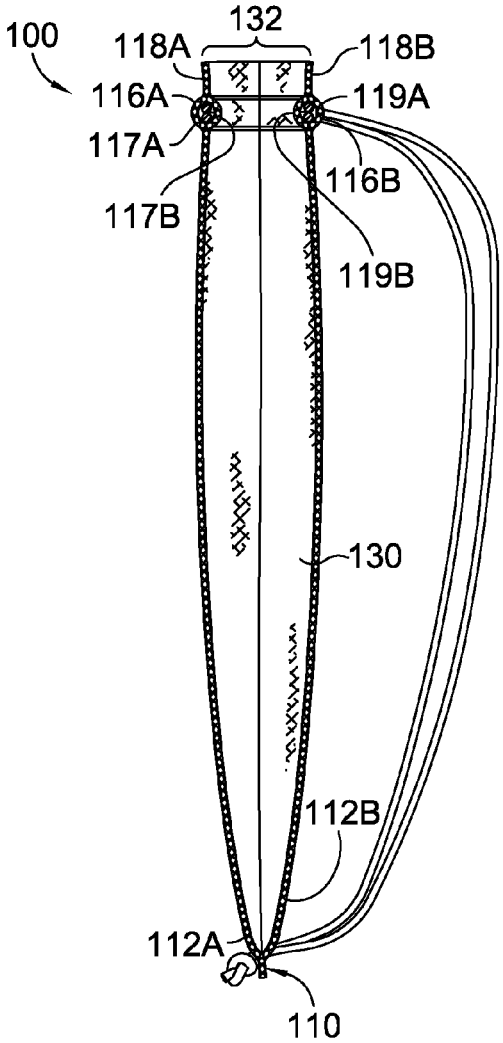
FIG. 2 depicts a cross-section of the bag depicted in FIG. 1 illustrating how the different panels of the woven bag are contiguously woven from the same filaments in an embodiment of the present invention.

Turning now to FIG. 2, a cross-section taken through the bag 100 when the bag 100 is in a flattened position is depicted. Using FIG. 1 as a guide, FIG. 2 depicts the terminal end portion 110. The two side panels 112A and 112B extend from the terminal end portion 110 and are contiguously woven from the terminal end portion 110. The two side panels 112A and 112B partially define a cavity 130. Additionally, the two side panels 112A and 112B comprise a first and second opposed outer surface and a first and second adjacent inner surface (i.e., the surface adjacent to the cavity 130)

Continuing on, the first channel 116A is constructed from two panels 117A and 117B that extend from the side panel 112A and are contiguously woven from the side panel 112A. The two panels 117A and 117B comprise a first and second opposed outer surface and a first and second adjacent inner surface (i.e., the surface adjacent to the first channel 116A) Likewise, the second channel 116B is constructed from two panels 119A and 119B that extend from the side panel 112B and are contiguously woven from the side panel 112B. Like above, the two panels 119A and 119B comprise a first and second opposed outer surface and a first and second adjacent inner surface (i.e., the surface adjacent to the cavity 130). As can be seen from FIG. 2, in one aspect, the first channel 116A and the second channel 116B may be vertically stacked upon each other when the bag 100 is in a horizontal, flattened arrangement.

The two end portions 118A and 118B extend from the panels 117A/117B and 119A/119B that comprise the first channel 116A and the second channel 116B respectively. In other words, the end portion 118A is contiguously woven from the panels 117A and 117B, and the end portion 118B is contiguously woven from the panels 119A and 119B. The two end portions 118A and 118B define an opening 132 into the bag 100. The two end portions 118A and 118B comprise a first and second opposed outer surface and a first and second adjacent inner surface (i.e., the surface adjacent to the opening 132 into the cavity 130).

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A woven bag that, in a flattened position, has one or more stacked channels, the woven bag comprising:

a terminal end portion woven from a plurality of filaments to form a single layer;

a first panel woven from the same plurality of filaments and contiguously extending from the terminal end;

a second panel woven from the same plurality of filaments and contiguously extending from the terminal end, the first panel and the second panel partially defining a cavity, the first panel and the second panel being woven together to form a first single layer side portion adjacent to the cavity and extending along a first side of the woven bag and a second single layer side portion adjacent to the cavity and extending along a second side of the woven bag when in a flattened position, wherein the first single layer side portion and the second single layer side portion contiguously extend from the terminal end portion;

a third panel woven from the same plurality of filaments and contiguously extending from the first panel;

a fourth panel woven from the same plurality of filaments and contiguously extending from the first panel, the third panel and the fourth panel defining a first channel and the cavity therein;

a fifth panel woven from the same plurality of filaments and contiguously extending from the second panel;

a sixth panel woven from the same plurality of filaments and contiguously extending from the second panel, the fifth panel and the sixth panel defining a second channel and the cavity therein;

a seventh panel woven from the same plurality of filaments and contiguously extending from the third panel and the fourth panel;

an eighth panel woven from the same plurality of filaments and contiguously extending from the fifth panel and the sixth panel, the seventh panel and the eighth panel defining an opening into the cavity of the bag; and an aperture extending across the first channel and the second channel.

2. The woven bag of claim 1, wherein the aperture extends across the first channel and the second channel at the first side of the woven bag.

3. The woven bag of claim 1, wherein the aperture extends across the first channel and the second channel at the first side and the second side of the woven bag.

4. The woven bag of claim 1, further comprising at least one drawstring extending through the first channel and the second channel and extending through the aperture.

5. The woven bag of claim 4, wherein the at least one drawstring attaches to the terminal end portion.

6. The woven bag of claim 5, wherein the at least one drawstring attaches to a first side and to a second side of the terminal end portion.

7. The woven bag of claim 5, wherein the at least one drawstring attaches to the terminal end portion by extending through a circular opening and terminates in a knot.

8. The woven bag of claim 7, wherein the circular opening is constructed by altering a weaving pattern of the terminal end portion.

9. The woven bag of claim 1, wherein the plurality of filaments comprises at least one of a nylon filamentary materials or polyester filamentary materials.

10. The woven bag of claim 1, wherein the aperture is constructed by incising across the first channel and the second channel.

11. The woven bag of claim 10, wherein the aperture is reinforced by stitching.

12. The woven bag of claim 1, wherein the aperture is constructed by altering a weaving pattern of the first channel and the second channel.

13. A woven bag, the bag comprising:

a single woven layer corresponding to a terminal end of the bag;

a first and second woven layer contiguously woven from the single layer and contiguously extending from the single layer, the first and second woven layers partially defining a cavity, wherein the first woven layer and the second woven layer are woven together to form a first single layer side portion adjacent to the cavity and extending along a first side of the bag and a second single layer side portion adjacent to the cavity and extending along a second side of the bag when in a flattened position, wherein the first single layer side portion and the second single layer side portion contiguously extend from the single woven layer corresponding to the terminal end of the bag;

a third and fourth woven layer contiguously woven from the first layer and contiguously extending from the first layer, the third and fourth woven layers defining a first channel and the cavity therein;

a fifth and sixth woven layer contiguously woven from the second layer and contiguously extending from the second layer, the fifth and sixth woven layers defining a second channel and the cavity therein, wherein the first channel and the second channel are vertically stacked when the woven bag is in a flattened arrangement;

a seventh woven layer contiguously woven from the third and fourth woven layers and contiguously extending from the third and fourth woven layers;

an eighth woven layer contiguously woven from the fifth and sixth woven layers and contiguously extending from the fifth and sixth woven layers, the seventh layer and the eighth layer defining an opening into the bag.

14. The woven bag of claim 13, wherein:

(1) the first and second woven layers comprise a first and second opposed outer surface and a first and second adjacent inner surface, (2) the third and fourth woven layers comprise a third and fourth opposed outer surface and a third and fourth adjacent inner surface, (3) the fifth and sixth woven layers comprise a fifth and sixth opposed outer surface and a fifth and sixth adjacent inner surface, and (4) the seventh and eighth woven layers comprise a seventh and eighth opposed outer surface and a seventh and eighth adjacent inner surface.

15. A woven bag that, in a flattened position, has one or more stacked channels, the woven bag comprising:

a terminal end portion woven from a plurality of filaments to form a single fabric of eight layers of thickness;

a first panel woven from the same plurality of filaments and contiguously extending from the terminal end portion, the first panel comprising a single fabric of four layers of thickness;

a second panel woven from the same plurality of filaments and contiguously extending from the terminal end portion, the second panel comprising a single fabric of four layers of thickness, the first panel and the second panel being woven together to form a first single fabric of eight layers of thickness adjacent to the cavity and extending along a first side of the woven bag and a second single fabric of eight layers of thickness adjacent to the cavity and extending along a second side of the woven bag when in a flattened position;

a third panel woven from the same plurality of filaments and contiguously extending from the first panel, the third panel comprising a single fabric of two layers of thickness;

a fourth panel woven from the same plurality of filaments and contiguous extending from the first panel, the fourth panel comprising a single fabric of two layers of thickness, the third panel and the fourth panel defining a first channel and a cavity therein;

a fifth panel woven from the same plurality of filaments and contiguously extending from the second panel, the fifth panel comprising a single fabric of two layers of thickness;

a sixth panel woven from the same plurality of filaments and contiguously extending from the second panel, the sixth panel comprising a single fabric of two layers of thickness, the fifth panel and the sixth panel defining a second channel and a cavity therein;

a seventh panel woven from the same plurality of filaments and contiguously extending from the third panel and the fourth panel, the seventh panel comprising a single fabric of four layers of thickness;

an eighth panel woven from the same plurality of filaments and contiguously extending from the fifth panel and the sixth panel, the eighth panel comprising a single fabric of four layers of thickness, the seventh panel and the eighth panel defining an opening into the cavity of the woven bag; and an aperture extending across the first channel and the second channel.

* * * * *